United States Patent [19]

Ohta et al.

[11] 4,209,327

[45] Jun. 24, 1980

[54] ELECTROPHOTOGRAPHIC SENSITIVE ELEMENT WITH BENZYLAMINO CARBAZOLE CHARGE TRANSFER MATERIAL

[75] Inventors: Masafumi Ohta, Yokohama; Kiyoshi Sakai, Tokyo, both of Japan

[73] Assignee: Ricoh Co., Ltd., Tokyo, Japan

[21] Appl. No.: 952,007

[22] Filed: Oct. 17, 1978

[30] Foreign Application Priority Data

Oct. 20, 1977 [JP] Japan ..... 52-125183

[51] Int. Cl.[2] ..... G03G 5/04; G03G 5/14

[52] U.S. Cl. ..... 430/82; 260/315

[58] Field of Search ..... 96/1.5 R, 1.6; 260/315

[56] References Cited

U.S. PATENT DOCUMENTS

| | | | |
|---|---|---|---|
| 3,833,596 | 9/1974 | Albrecht et al. | 260/315 X |
| 3,852,208 | 12/1974 | Nagashima et al. | 96/1.5 R X |
| 3,953,207 | 4/1976 | Horgan | 96/1.5 R X |
| 4,072,520 | 2/1978 | Rochlitz et al. | 96/1.5 R |
| 4,111,850 | 9/1978 | Kwalwasser | 260/315 X |

FOREIGN PATENT DOCUMENTS

| | | | |
|---|---|---|---|
| 1337228 | 11/1973 | United Kingdom | 96/1.5 R |

*Primary Examiner*—Roland E. Martin, Jr.

*Attorney, Agent, or Firm*—Blanchard, Flynn, Thiel, Boutell & Tanis

[57] ABSTRACT

The present invention provides an electrophotographic sensitive element which comprises an electroconductive support and a photosensitive layer formed thereon and containing some charge-carrier generating pigment and a specific charge transfer substance. Said specific charge transfer substance is just a substance selected from well-known photoconductive substances, but when it is applied in combination with a charge-carrier generating pigment, it renders a photosensitive element having a remarkably improved sensitivity.

7 Claims, 3 Drawing Figures

ELECTROPHOTOGRAPHIC SENSITIVE ELEMENT WITH BENZYLAMINO CARBAZOLE CHARGE TRANSFER MATERIAL

BACKGROUND OF THE INVENTION (a) Field of the Invention

The present invention relates to a photosensitive element for use in electrophotography, and more particularly to an electrophotographic sensitive element consisting of an electroconductive support provided with a photosensitive layer comprising a charge-carrier generating pigment combined with a specific charge transfer substance.

(b) Description of the Prior Art

There have hitherto been developed and put to use a variety of electrophotographic sensitive elements in compliance with various electrophotographic copying processes. However, all of these photosensitive elements in the prior art still leave much to be desired. For instance, a selenium-type photosensitive element is defective in that it is poor in flexibility so that it cannot be formed into sheet and is apt to be flawed, and also as inferior in heat resistance. A zinc oxide-type photosensitive element is defective in that it is low in sensitivity, inferior in printing durability, and poor in chargeability. And, as for a charge-transferable complex type photosensitive element (consisting of an acceptor and a donor) which has recently come into limelight and been put to practical use, it is still unsatisfactory in respect of sensitivity.

SUMMARY OF THE INVENTION

An object of the present invention is to provide an electrophotographic sensitive element which is free from the aforementioned defects of the existing photosensitive elements. Another object of the present invention is to provide an electrophotographic sensitive element which can be easily prepared and has an excellent durability.

As the result of a series of studies, the present inventors have found that specific ones of the compounds prevalently used as photoconductive substance can act as a charge transfer substance rather than a photoconductive substance when applied in combination with a charge-carrier generating pigment, and render it possible to attain the foregoing objects. The present invention has been accomplished on the basis of this finding.

More specifically, the present invention is to provide an electrophotographic sensitive element comprising an electroconductive support and a photosensitive layer containing a charge-carrier generating pigment and a charge transfer substance as formed on said support, in which said charge transfer substance is at least one member of 3,6-bis(dibenzylamino)carbazole compounds represented by the following general formula:

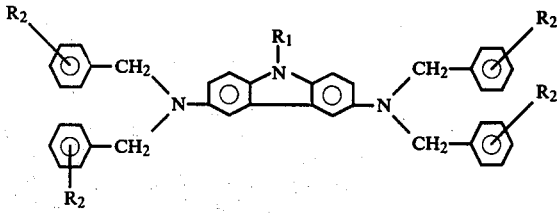

(wherein $R_1$ is selected from the group consisting of lower alkyl radical having 1 to 4 carbon atoms, benzyl radical and benzyl radical substituted halogen atom; and $R_2$ is selected from the group consisting of methyl radical, halogen atom and hydrogen.)

The "charge-carrier generating pigment" herein means a pigment which is recognized as capable of generating charge carrier when light is applied thereon. The "charge transfer substance" herein, on the other hand, means a substance which is considered to have a function of pouring and transferring the charge carrier generated from the charge-carrier generating pigment.

The above-defined charge transfer substance useful in the present invention [3,6-bis(dibenzylamino)carbazole compound] is included in the known substances. And, the process for preparation and/or the use thereof as photoconductive substance in electrophotographic sensitive element are disclosed in, for instance, Japanese Unexamined Patent Publication No. 11053/1973.

As stated above, in the present invention, as the result of combined use of said well-known specific substance [to wit, compound represented by the general formula] and charge-carrier generating pigment, the former substance acts as charge transfer substance, not as photoconductive substance as hitherto deemed, and there can be obtained a photosensitive element particularly superior to the conventional ones in respect of sensitivity.

As electrophotographic copying method, there are known varieties of methods, and all of these methods comprise a process of applying light (or imagewise exposure). This process of imagewise exposure is for the purpose of selectively imparting electroconductivity to the photosensitive layer by selectively exposing a photosensitive element. A photosensitive element according to the present invention can perform this process more effectively than hitherto known photosensitive elements even when applied to any of hitherto known electrophotographic copying methods.

As for the charge-carrier generating pigment to be combined with the aforementioned specific charge transfer substance in the photosensitive element of the present invention, there is no necessity for employing any specific pigment, that is, it can be optionally selected. However, to cite charge-carrier generating pigments especially useful for the present invention, there are azo pigments [namely, azo pigment having carbazole skeleton (for instance, as disclosed in Japanese Appln. Nos. 8740/1977 or 8741/1977), azo pigment having styryl stilbene skeleton (for instance, as disclosed in Japanese Appln. No. 48859/1977), azo pigment having triphenylamine skeleton (for instance, as disclosed in Japanese Appln. No. 45812/1977), azo pigment having dibenzothiophene skeleton (for instance, as disclosed in Japanese Appln. No. 86255/1977), azo pigment having oxadiazole skeleton (for instance, as disclosed in Japanese Appln. No. 77155/1977), azo pigment having fluorenone skeleton (for instance, as disclosed in Japanese Appln. No. 87351/1977), azo pigment having stilbene skeleton (for instance, as disclosed in Japanese Appln. No. 81790/1977), azo pigment having distyryl oxadiazole skeleton (for instance, as disclosed in Japanese Appln. No. 66711/1977), and azo pigment having distyryl carbazole skeleton (for instance, as disclosed Japanese Appln. No. 81791/1977)].

In addition to these azo pigments, the following substances which are generally known are also applicable as charge-carrier generating pigment: inorganic pigments such as selenium, selenium-tellurium, cadmium sulfide, cadmium sulfide-selenium, etc.; organic pigments including azo-type pigments such as CI Pigment Blue 25 [CI (color index) 21180; alias "Dian Blue"], CI Pigment Red 41 (CI 21200), CI Acid Red 52 (CI 45100), CI Basic Red 3 (CI 45210), etc., phthalocyanine-type pigments such as CI Pigment Blue 16 (CI 74100), etc., indigo-type pigments such as CI Bat Brown 5 (CI 73410), CI Bat Dye (CI 73030), etc., and perylene-type pigments such as Algo-Scarlet B (the manufacture of Bayer Co.), etc.

BRIEF DESCRIPTION OF THE DRAWINGS

In the appended drawings.

DETAILED DESCRIPTION OF THE INVENTION

As described in the foregoing, a photosensitive element according to the present invention is characterized in that a charge-carrier generating pigment is combined with a specific charge transfer substance. Therefore, as far as a photosensitive element satisfies this condition, whatever stratiform structure it may assume, it will be included in the present invention. To give instances, there are a dispersion-type photosensitive element prepared by providing a photosensitive layer formed by dispersing fine particles of a charge-carrier generating pigment in a charge transfer substance on an electroconductive support, and a laminate-type photosensitive element prepared by superposing a layer of the foregoing charge transfer substance (hereinafter referred to as charge transfer layer) on a thin layer of a charge-carrier generating pigment (hereinafter referred to as charge-carrier generating layer) or by providing a photosensitive layer consisting of a charge transfer layer and a charge-carrier generating layer laid thereon on an electroconductive support.

Figure 1:
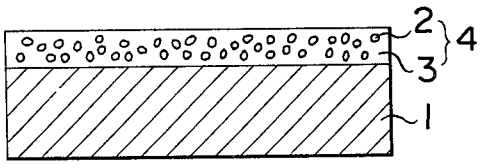
FIG. 1 is a diagrammatic cross-sectional view, on an enlarged scale, of a dispersion type photo-sensitive element according to the present invention.
Figure 2:
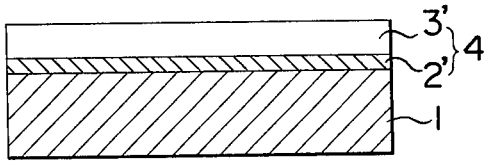
FIG. 2 and FIG. 3 are respectively a diagrammatic cross-sectional view, on an enlarged scale, of a laminate-type photosensitive element according to the present invention.
Figure 3:
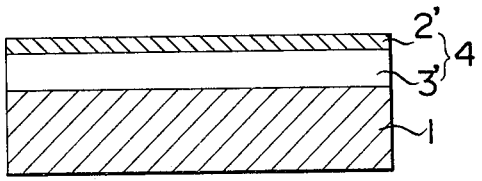

FIG. 1 illustrates the former dispersion-type electrophotographic sensitive element, and FIG. 2 and FIG. 3 illustrate respectively the latter laminate-type electrophotographic sensitive element. In these drawings, the reference numeral 1 denotes an electroconductive support, 2 denotes a charge-carrier generating pigment, 2' denotes a charge-carrier generating layer, 3 denotes a charge transfer substance, 3' denotes a charge transfer layer, and 4 denotes a photosensitive layer composed of said charge-carrier generating pigment 2 (or charge-carrier generating layer 2') and charge transfer substance 3 (or charge transfer layer 3').

As illustrated in FIG. 2 and FIG. 3, in the case of a laminate-type photosensitive element, the charge transfer layer 3' can be formed either on the topside of the charge-carrier generating layer 2' or on the underside thereof, but when the mechanical strength of the photosensitive element is taken into consideration, it is generally desirable to dispose the charge transfer layer 3' on the topside of the charge-carrier generating 2'.

In the case of the dispersion-type electrophotographic sensitive element prepared by dispersing the charge-carrier generating pigment 2 in the medium of charge-transfer substance 3, charging of the photosensitive element with positive electricity makes the sensitivity thereof higher than otherwise electrified. As to the laminate-type photosensitive element on the other hand, in the case where the charge transfer layer 3' is disposed on the topside of the charge-carrier generating layer 2', charging of the photosensitive element with negative electricity makes the sensitivity thereof higher than otherwise electrified, and in the case where the charge transfer layer 3' is disposed on the underside of the charge-carrier generating layer 2', charging of the photosensitive element with positive electricity makes the sensitivity thereof higher than otherwise electrified.

The reason for this is yet to be clarified, but it is, presumably, attributable to the charge transfer layer 3' comprising the aforesaid specific compound [3,6-bis(-dibenzylamino)carbazole] which plays the role of transferring holes effectively. Besides, the so-called photoconductivity generally includes at least two phenomena, to wit, (1) generation of charge and (2) transfer of charge, and accordingly, the present invention is intended to utilize the efficiency of the aforesaid specific compounds capable of transferring the electric charge generated by a charge-carrier generating pigment. Moreover, these compounds are considered not only to be capable of transferring the electric charge but also to have an ability of readily accepting the electric charge generated by a charge-carrier generating pigment.

As the binder resin for use in the charge transfer layer, there are many organic high-molecular compounds such as polyester, polyamide, polyurethane, polyketone, polycarbonate, vinyl polymer, etc. In addition, poly-N-vinyl carbazole, polyvinyl pyrene, polyvinyl anthracene, polyvinyl benzocarbazole, pyrene-formaldehyde resin, bromopyrene-formaldehyde resin, etc. which are intrinsically photoconductive are also effective. And, as applicable plasticizer, there are biphenyl chloride, dibutyl phthalate, dimethyl naphthalene, paraffin halide, etc.

In order to prepare an electrophotographic sensitive element according to the present invention, in the case of the dispersion-type photosensitive element illustrated in FIG. 1, it will do to follow the procedure comprising preparing a pigment dispersion by pulverizing a charge-carrier generating pigment together with an adequate dispersion medium, such as tetrahydrofuran, by the use of a crushing means such as ball mill, adding to this pigment dispersion one kind of the 3,6-bis(dibenzylamino)carbazole compounds together with an adequate binder resin and an adequate plasticizer as occasion demands and mixing these substances together to obtain a coating liquid, or dissolving one kind of the 3,6-bis(dibenzylamino)carbazole compounds together with an adequate binder resin and an adequate plasticizer as occasion demands in a solvent such as tetrahydrofuran, further adding a charge-carrier generating pigment to the resulting solution and crushing and mixing by the use of a crushing means such as ball mill to obtain a coating liquid, applying this coating liquid onto an electroconductive support such as, for instance, a plate of metal such as aluminum, a plastic film deposited with a metal such as aluminum through vacuum evaporation, a paper processed for conductivity, etc. by the use of a doctor blade or the like, and drying thereafter. The amount of the 3,6-bis(dibenzylamino)carbazole compounds to be contained in the photosensitive layer 4 on this occasion is in the range of from 10 to 60% by weight, preferably from 30 to 50% by weight. And, the particle diameter of the charge-carrier generating pigment 2 is about 5 microns or less, preferably 2 microns or less, and the amount of this pigment 2 to be contained in the photosensitive layer 4 is in the range of from 50 to 1% by weight, preferably from 20 to 1% by weight. Further, the thickness of the photosensitive layer 4 is about 3 to 100 microns, preferably 5 to 30 microns, in terms of thickness after drying.

In the case of preparing the laminate-type photosensitive element illustrated in FIG. 2, it will do to follow the procedure comprising forming a charge-carrier generating pigment layer 2' consisting solely of a charge-carrier generating pigment, or a charge-carrier generating pigment layer 2' consisting of a mixture of a charge-carrier generating pigment and a binder resin as occasion demands, on an electroconductive support 1 by depositing through vacuum evaporation, coating, or the like, and thereafter forming on this layer 2' a charge transfer layer 3' comprising one kind of the 3,6-bis(dibenzylamino)carbazole compounds as charge transfer substance by coating. As to the amount of the 3,6-bis(dibenzylamino)carbazole compounds to be contained in the charge transfer layer 3' on this occasion, it is appropriate to be in the range of from 10 to 60% by weight when the conditions for preparation of the photosensitive element, etc. are taken into consideration. And, as to the thickness of this charge transfer layer 3', it is appropriate to be in the range of from 5 to 100 microns. As to the coating liquid for use in forming the charge-carrier generating layer for the laminate-type photosensitive element by coating, it will do to prepare a pigment dispersion by pulverizing a charge-carrier generating pigment into fine particles of 5 microns or less, preferably 2 microns or less, in diameter together with an appropriate dispersion medium such as tetrahydrofuran by the use of a crushing means such as ball mill and coat this dispersion by the use of a doctor blade or the like or coat it upon dissolving in a soluble solvent, and thereafter let it separate as fine crystals by drying. On this occasion, when the charge-carrier generating layer 2' is composed of a charge-carrier generating pigment and a binder resin, it is desirable that the amount of said binder resin be relatively small, preferably in the range of from 50 to 5% by weight. The appropriate thickness of the charge-carrier generating layer 2' is in the range of from 0.05 to 20 microns, preferably from 0.1 to 5 microns.

Further, in the case of a laminate-type photosensitive element illustrated in FIG. 3, it is of a stratiform structure formed by reversing the order of the charge-carrier generating layer 2' and the charge transfer layer 3' of the foregoing photosensitive element of FIG. 2, and can be prepared by applying the same procedure as that for the element in FIG. 2.

Besides, when a layer consisting of a resin such as polyamide, polyvinyl acetate, polyurethane, etc. or a layer of aluminum oxide having a thickness of 0.01 to 2 microns is formed on the electroconductive support 1 for use in the present invention and thereafter a photosensitive layer is provided thereon, the adhesion between the electroconductive support and the photosensitive layer becomes more satisfactory and, moreover, the electrification property of the photosensitive element can also be improved in some degree.

The thus prepared photosensitive elements according to the present invention well answer the purpose of the present invention from the view point of (a) realization of high sensitivity and (b) decrease of fatigue to be caused by repetition of electrification and exposure.

DESCRIPTION OF THE PREFERRED EMBODIMENTS

The term "part" used in the following examples always means "part by weight".

Example 1

Upon adding 98 parts of tetrahydrofuran, 2 parts of Dian Blue (CI 21180) were crushed and mixed within a ball mill, whereby a charge-carrier generating pigment dispersion was prepared. By coating this dispersion by the use of a doctor blade on a polyester film deposited with aluminum through vacuum evaporation, and drying naturally thereafter, there was formed a 1$\mu$-thick charge-carrier generating layer.

Next, a charge transfer layer forming liquid obtained by mixing 2 parts of 3,6-bis(dibenzylamino)-9-ethylcarbazole represented by the formula

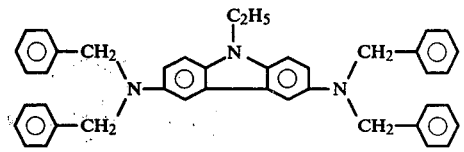

3 parts of polycarbonate (namely, Panlite, the manufacture of TEIJIN Co.) and 45 parts of tetrahydrofuran was coated on the foregoing charge-carrier generating layer by the use of a doctor blade and was dried at 100° C. for 10 minutes so as to form a 9$\mu$-thick charge transfer layer, whereby there was prepared a photosensitive element according to the present invention.

Subsequently, this photosensitive element was negatively charged by means of corona discharge of $-6$ KV for 20 seconds in a testing apparatus for electrostatic copying paper (namely, MODEL SP428, the manufacture of K. K. KAWAGUCHI DENKI SEISAKUSHO), and the surface potential Vpo(volt) thereof was measured after standing it for 20 seconds in the dark. Successively, the surface of this element was exposed to the light of a tungsten lamp so as to attain the surface illumination of 20 luxes, and the amount of exposure $E_{\frac{1}{2}}$ (in terms of lux.sec) was determined from the time of exposure (in terms of second) required for decrease of the surface potential Vpo to half. The obtained results were:

Vpo: $-1020$ V $E_{\frac{1}{2}}$: 9.2 lux·sec.

Example 2

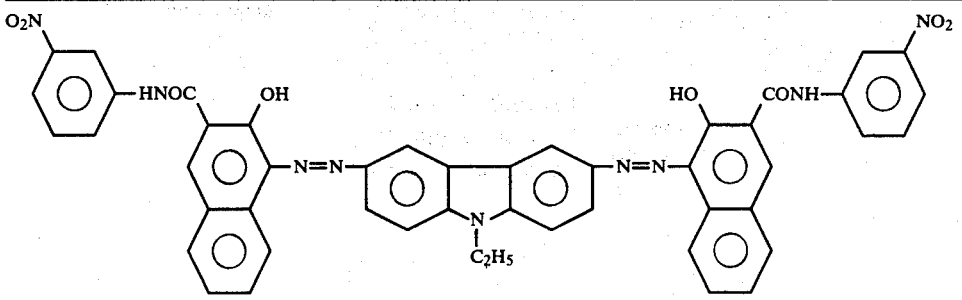

3 parts polyester resin (Polyester Adhesive 49,000, the manufacture of Du Pont Inc.) 1 part tetrahydrofuran 96 parts A liquid having the foregoing composition was crushed and blended in a ball mill, whereby there was obtained a charge-carrier generating pigment dispersion. By coating this dispersion by the use of a doctor blade on a polyester film deposited with aluminum through vacuum evaporation and drying thereafter in a drier at 80° C. for 5 minutes, a 1μ-thick charge-carrier generating layer was formed thereon.

Subsequently, a charge transfer layer forming liquid obtained by mixing 2 parts of 3,6-bis(di-4'-chlorobenzylamino)-9-n-propylcarbazole represented by the formula

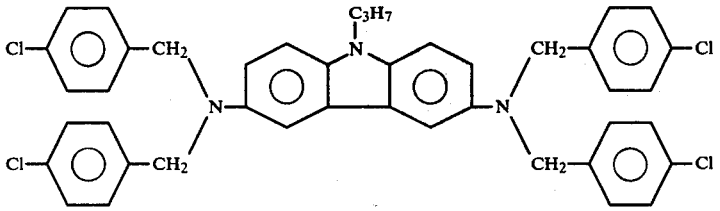

3 parts of polycarbonate (namely, Panlite) and 45 parts of tetrahydrofuran together was coated on the foregoing charge-carrier generating layer by the use of a doctor blade and was dried at 100° C. for 10 minutes so as to form a 10μ-thick charge transfer layer, whereby there was prepared a photosensitive element according to the present invention.

When this photosensitive element was charged negatively and subjected to measurement of Vpo and $E\frac{1}{2}$ in the same way as in Example 1. The obtained results were:

Vpo: −1280 V $E\frac{1}{2}$: 7.6 lux·sec.

Example 3

By applying the same procedure as in Example 2 except for using a compound having the structural formula

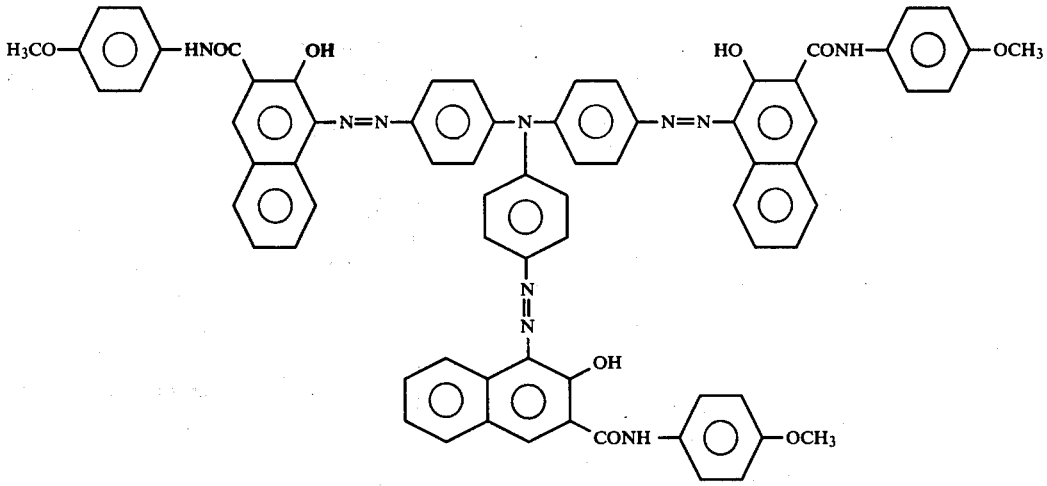

as charge-carrier generating pigment and using a compound having the structural formula

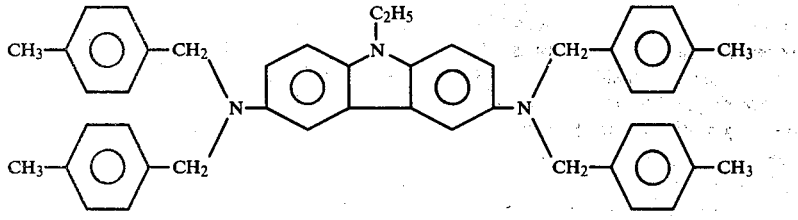

as the charge transfer substance, there was prepared a photosensitive element according to the present invention. When this photosensitive element was subjected to the same measurements as in Example 1, the obtained results were:

Vpo: −1420 V
$E_{\frac{1}{2}}$: 3.2 lux·sec.

Example 4

By applying the same procedure as in Example 2 except for using a compound represented by the structural formula

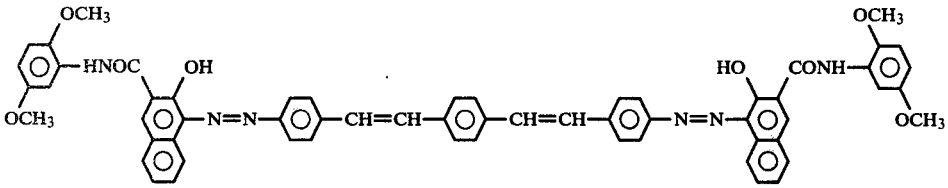

as charge-carrier generating pigment and using a compound having the structural formula

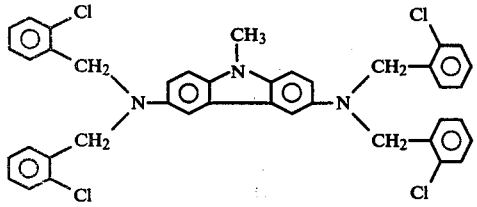

as the charge transfer substance, there a photosensitive element according to the present invention was prepared. When this photosensitive element was subjected to the same measurement as in Example 1, the obtained results were:

Vpo: −1320 V
$E_{\frac{1}{2}}$: 5.4 lux·sec.

Example 5

After negatively charging the respective photosensitive elements obtained in Examples 1 through 4 by the use of a commercial copying apparatus, an electrostatic latent image was formed by applying light thereto through an original, the thus formed latent image was developed by means of a dry developer comprising a positively charged toner, and then the developed image was electrostatically transferred onto a slick paper and fixed, whereby there was obtained a clear-cut image, respectively. Even when a wet developer was employed, the resulting image was equally distinct.

Example 6

A charge-carrier generating layer was formed on an aluminum plate of about 300μ in thickness by depositing selenium to the extent of 1μ in thickness through vacuum evaporation. Next, a charge transfer layer forming liquid was prepared by mixing 2 parts of 3,6-bis(dibenzylamino)-9-benzylcarbazole, 3 parts of a polyester resin (namely, Polyester Adhesive 49,000, the manufacture of Du Pont Inc.) and 45 parts of tetrahydrofuran together. Then, this liquid was coated on the foregoing charge-carrier generating layer (or selenium-deposited layer) by the use of a doctor blade, dried naturally, and further dried under a reduced pressure thereafter so as to form a 10μ-thick charge transfer layer, whereby there was obtained a photosensitive element according to the present invention.

When this photosensitive element was subjected to measurement of Vpo and $E_{\frac{1}{2}}$ in the same way as in Example 1, the obtained results were:

Vpo: −1240 V
$E_{\frac{1}{2}}$: 9.4 lux·sec.

Example 7

By depositing a perylene type pigment represented by the structural formula

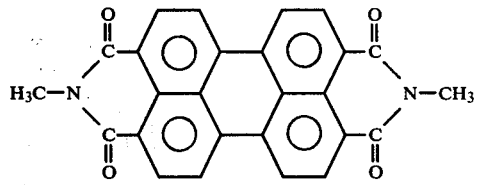

through vacuum evaporation to the extent of 0.3μ in thickness in place of selenium used in Example 6, a charge-carrier generating layer was formed. Subsequently, a photosensitive element was prepared by applying the same procedure as in Example 6 except for replacing the charge transfer substance with 3,6-bis(dibenzylamino)-9-(4''-chlorobenzyl)carbazole. When this photosensitive element was subjected to the same measurement as in Example 1, the obtained results were:

Vpo: −1040 V
$E_{\frac{1}{2}}$: 5.0 lux·sec.

Example 8

After negatively charging the respective photosensitive elements obtained in Examples 6 and 7 by the use of a commercial copying apparatus, an electrostatic latent image was formed by applying light thereto through an original, the thus formed latent image was developed by means of a dry developer comprising a positively charged toner, and then the developed image was electrostatically transferred onto a slick paper and fixed, whereby there was obtained a clear-cut image, respectively. Even when a wet developer was employed in place of said dry developer, the resulting image was equally distinct.

Example 9

A mixture prepared by adding 158 parts of tetrahydrofuran to 1 part of Chlorodian Blue was crushed and blended within a ball mill, and thereafter 12 parts of 3,6-bis(dibenzylamino)-9-ethylcarbazole together with 18 parts of a polyester resin (namely, Polyester Adhesive 49,000) were added and mixed therein, whereby a photosensitive layer forming liquid was prepared. Then, by coating this liquid on a polyester film deposited with aluminum through vacuum evaporation by the use of a doctor blade and drying at 100° C. for 30 minutes so as to form a 16μ-thick photosensitive layer, there was obtained a photosensitive element according to the present invention.

When this photosensitive element was positively charged by means of corona discharge of +6 KV in the same apparatus as used in Example 1 and was subjected to measurement of Vpo and $E_{\frac{1}{2}}$ in the same way as in Example 1, the obtained results were:

Vpo: 1000 V $E_{\frac{1}{2}}$: 7.6 lux·sec.

Example 10

By applying the same procedure as in Example 9 except for using a compound represented by the structural formula

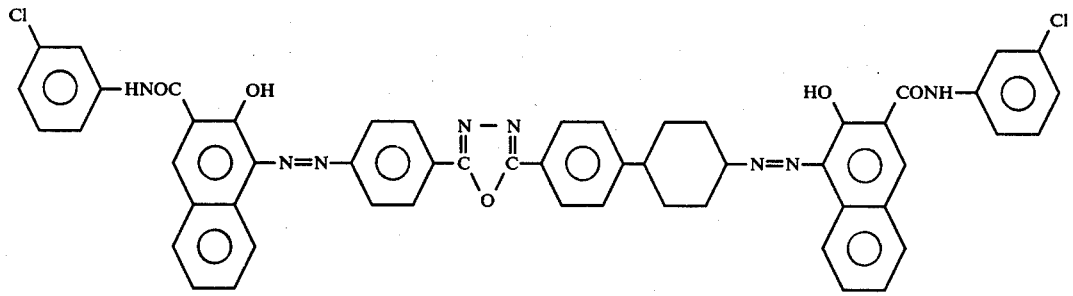

as charge-carrier generating pigment and using a compound represented by the structural formula

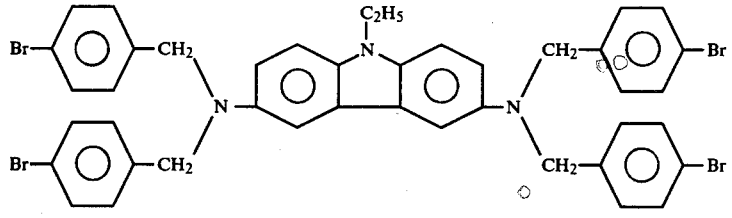

as charge transfer substance, a photosensitive element was prepared. When the respective photosensitive elements were subjected to the same measurement as in Example 9, the obtained results were:

Vpo: 1340 V $E_{\frac{1}{2}}$: 5.4 lux·sec.

Example 11

By applying the same procedure as in Example 9 except for using a compound represented by the structural formula

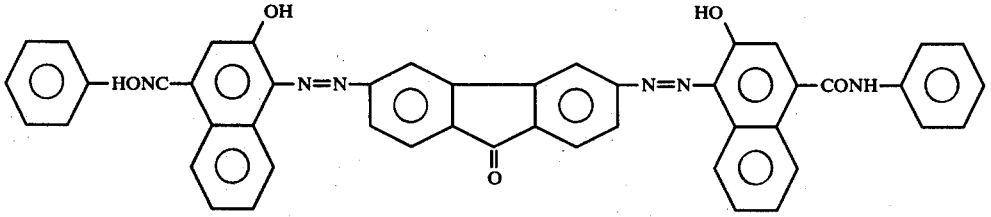

as charge-carrier generating pigment and using a compound represented by the structural formula

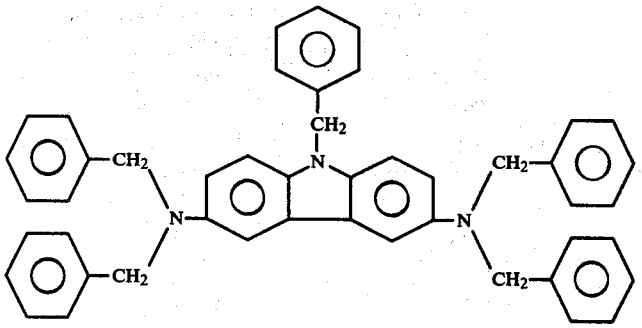

as charge transfer substance, a photosensitive element was prepared. When this photosensitive element was subjected to the same measurement as in Example 9, the obtained results were:

Vpo: 1060 V $E_{\frac{1}{2}}$: 3.6 lux·sec.

Example 12

By applying the same procedure as in Example 9 except for using compound represented by the structural formula

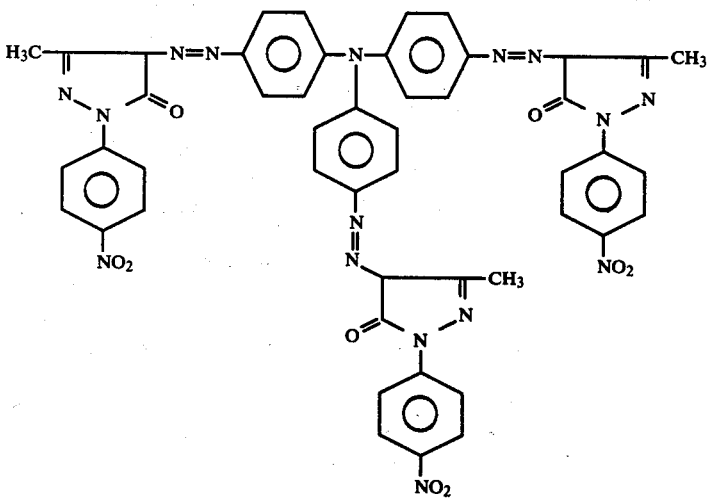

as charge-carrier generating pigment and using a compound represented by the structural formula

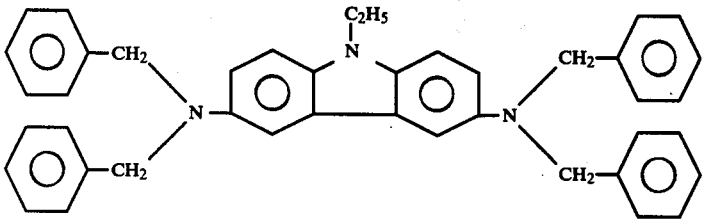

as charge transfer substance, a photosensitive element was prepared. When this photosensitive element was subjected to the same measurement as in Example 9, the obtained results were:

Vpo: 1240 V $E_{\frac{1}{2}}$: 7.0 lux·sec.

Example 13

After positively charging the respective photosensitive elements obtained in Example 9 through 12 by the use of a commercial copying apparatus, an electrostatic latent image was formed by applying light thereto through an original, the thus formed latent image was developed by means of a dry developer comprising a negatively charged toner, and then the developed image was electrostatically transferred onto a slick paper and fixed, whereby there was obtained a clear-cut image, respectively. Even when a wet developer was employed in place of said dry developer, the resulting image was equally clear-cut.

Comparative Example

As a comparative example for the purpose of confirming the effect of the present invention, a photosensitive element was prepared by forming only a layer comprising 3,6-bis(dibenzylamino)-9-ethylcarbazole on an electroconductive support without providing any charge-carrier generating layer. When this photosensitive element was charged with electricity by the use of the same apparatus as in Example 1, the obtained results were as follows:

Vpo: −1240 V, E½: 80 lux·sec. or more

Vpo: +1380 V, E½: 80 lux·sec. or more, showing that it was very inferior in photosensitivity in both cases of positive charging and negative charging. However, it will be seen that the use of 3,6-bis(dibenzylamino)carbazole compound as charge transfer substance in combination with a charge-carrier generating pigment as disclosed in the present invention permits the preparation of an electrophotographic sensitive element having a sensitivity sufficiently available for practical use.

What is claimed is:

1. An electrophotographic sensitive element which comprises an electroconductive support and a photosensitive layer containing a charge-carrier generating pigment and a charge transfer substance formed on said support, in which said charge transfer substance is at least one member of the group of compounds represented by the following general formula:

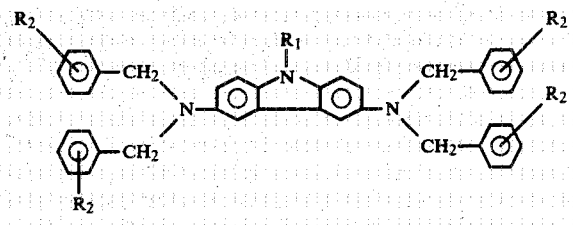

wherein $R_1$ is selected from the group consisting of lower alkyl radical having 1 to 4 carbon atoms, benzyl radical and benzyl radical substituted with halogen atom: and $R_2$ is selected from the group consisting of methyl radical, halogen atom and hydrogen.

2. A photosensitive element according to claim 1, in which said charge-carrier generating pigment is an azo pigment.

3. A photosensitive element according to claim 1, in which the amount of said charge transfer substance accounts for 10 to 60% by weight of the photosensitive layer.

4. An element according to claim 1, in which said charge transfer substance is

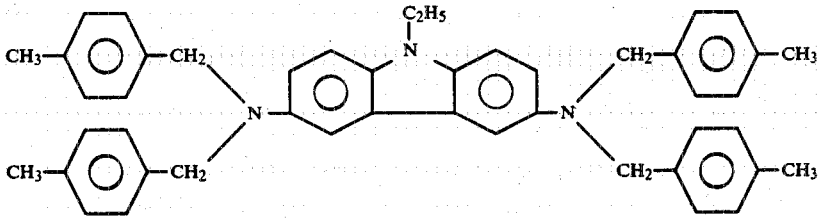

5. An element according to claim 1, in which said charge transfer substance is

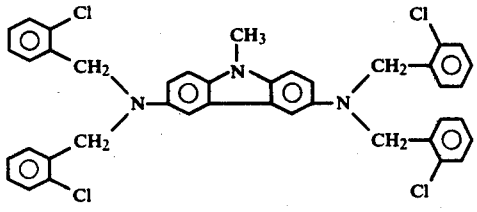

6. An element according to claim 1, in which said charge transfer substance is 3,6-bis(dibenzylamino)-9-(4''-chlorobenzyl)-carbazole.

7. An element according to claim 1, in which said charge transfer substance is 3,6-bis(dibenzylamino)-9-ethylcarbazole.

* * * * *